US006054659A

United States Patent [19]

Lee et al.

[11] Patent Number: 6,054,659

[45] Date of Patent: Apr. 25, 2000

[54] INTEGRATED ELECTROSTATICALLY-ACTUATED MICROMACHINED ALL-METAL MICRO-RELAYS

[75] Inventors: Han-Sheng Lee, Bloomfield Hills; Chi Hung Leung, Rochester Hills; Qian Shi, Novi; Shih-Chia Chang, Bloomfield Hills; David Byrum Hicks, Farmington Hills, all of Mich.; Samuel Lorincz, Boardman; Iulian Nedelescu, Cortland, both of Ohio

[73] Assignee: General Motors Corporation, Detroit, Mich.

[21] Appl. No.: 09/037,197

[22] Filed: Mar. 9, 1998

[51] Int. Cl.[7] ..... H01H 57/00

[52] U.S. Cl. ..... 200/181

[58] Field of Search ..... 200/181; 361/207

[56] References Cited

U.S. PATENT DOCUMENTS

| | | | |
|---|---|---|---|
| 4,658,320 | 4/1987 | Hongel | 361/13 |
| 4,959,515 | 9/1990 | Zavracky et al. | 200/181 |
| 5,049,221 | 9/1991 | Wada et al. | 156/151 |
| 5,258,591 | 11/1993 | Buck | 200/181 |
| 5,278,368 | 1/1994 | Kasano et al. | 200/181 |
| 5,578,976 | 11/1996 | Yao | 333/262 |
| 5,629,565 | 5/1997 | Schlaak et al. | 257/780 |
| 5,635,750 | 6/1997 | Schlaak et al. | 257/414 |
| 5,638,946 | 6/1997 | Zavracky | 200/181 |
| 5,652,688 | 7/1997 | Lee | 361/13 |

OTHER PUBLICATIONS

Nathanson et al, "The Resonant Gate Transistor," *IEEE Transactions on Electron Devices,* vol. ED–14, No. 3, Mar. 1967, pp. 117–133.

Petersen, "Micromechanical Membrane Switches on Silicon," *IBM J. Res. Develop.*, vol. 23, No. 4, Jul. 1979, pp. 376–385.

Petersen, "Silicon as a Mechanical Material," *Proc. IEEE*, vol. 70, No. 5, May 1982, pp. 420–457.

Rogge et al, "Fully Batch Fabricated Magnetic Microactuators Using a Two Layer LIGA Process,"*Transducers '95—Eurosensors IX*, 74–B2, Jun. 1995, pp. 320–323.

Roy et al, "Design, Fabrication, and Characterization of Electrostatic Microrelays," *SPIE*, vol. 2642, pp. 64–73; May 1995.

Yao et al, "A Surface Micromachined Miniature Switch for Telecommunications Applications with Signal Frequencies from DC up to 4 GHz," *Transducers '95—Eurosensors IX*, 330–B10, Jun. 1995, pp. 384–387.

*Primary Examiner*—Renee S. Luebke
*Attorney, Agent, or Firm*—Patrick M. Griffin

[57] ABSTRACT

Structures and fabrication methods of micromachined all-metal relays on silicon chips are described. The relay comprises a copper blade, electroformed into the lithographically patterned areas, with suitable dimensions of 1 mm×2 mm×0.01 mm (width×length×thickness) and a plurality of longitudinal slots to facilitate fabrication of the blade. The relay is actuated by electrostatic force, and no conduction current is required to hold the relay at either "on" or "off" state. Preferably, the relay is used in combination with a suitable arc suppression circuit.

19 Claims, 10 Drawing Sheets

INTEGRATED ELECTROSTATICALLY-ACTUATED MICROMACHINED ALL-METAL MICRO-RELAYS

TECHNICAL FIELD

This invention relates to very small electrostatically-actuated, metal relays capable of handling applications involving significant currents such as those encountered on automobile component systems.

BACKGROUND OF THE INVENTION

Relays are used to distribute power to selected loads. The type of relay used mostly is an electromagnetically-activated mechanical relay. The mechanical relays are reliable, can carry high current (>20 A) and are inexpensive. The drawbacks of the mechanical relays are that they are bulky and require a continuous current to generate the needed force to hold the contact. The holding current consumes battery energy and produces heat in the relay undesirably.

The other popular type of switch is a power transistor. Transistors are inexpensive when they are not used to carry high current. The switching time is short, which enables the transistor to switch power to different loads at very high speeds. Because of the practice of batch fabrication, many transistors are made simultaneously and uniformly. However, a heat sink is needed to dissipate the heat generated by a transistor when it carries high current. The heat sink adds cost to power transistors in high current applications.

There are needs for reliable, small and inexpensive relays. There is a particular need for small relays in automobile applications where the relay can carry a current of, e.g., two amperes more or less continuously and a current of 10 amperes for brief periods. An electrostatically-actuated, all-metal micro-relay fits into this category. It has the advantages of transistors, small size and batch fabrication capability. Hence, it can be a low cost product. Similar to the mechanical relay, the contact resistance of an all-metal relay can be very low. There is no need to use a heat sink when the contact resistance of the relay is low—about a few milliohms. Yet, the electrostatically-actuated relay does not need conduction current to hold the contact and, consequently, no waste in battery energy.

The concept of using an electrostatic force to deflect a cantilever beam to make a contact has been tried experimentally for years. Due to the fabrication methods and the materials used, such prior devices had limited applications. The main disadvantages of these devices were high actuation voltage (much higher than 50V) and low switched current (in milliamperes).

SUMMARY OF THE INVENTION

This invention provides very small, integrated all-metal micro-relays that are able to handle several amperes of current. The relays are suitably formed on a silicon oxide-insulated silicon substrate by standard microelectronics techniques. The relays include, for example, a thin current carrying electroformed, copper blade anchored at at least one of its ends to the substrate. A metallic electrostatic actuator and a metallic electrical contact(s) are formed in the insulated substrate underneath the beam. In response to an appropriate electrical signal, a voltage is applied to the actuator that causes the beam to bend into engagement with the contact member to complete an electrical circuit.

In order to be useful in automotive applications, small relays must be able to carry several amperes of current.

There are needs for relays that are capable of carrying about two amperes for long periods and to survive current surges of 10 amperes. The relays must be small so as to fit into doors, seats, instrument panels and the like. Several micro-relays have been made in accordance with the invention that satisfy these requirements. The dimensions of the electroformed copper current carrying blades of these prototype devices were in the range of 1.3 to 2.2 millimeters in length, 0.6 to 1 mm in width and about 0.01 mm in thickness. These relays were made by microelectronics fabrication methods that are described in detail below. The blade is a critical member of the relay because it must be sized to provide suitable current-carrying capacity for the metal composition of the beam. The long, wide and relatively thin flexible blades of these relays require unique lithographic processing considerations during the manufacture of the relays of this invention.

In accordance with one aspect of this invention, the blades are formed with several thin longitudinal slots. The slots are suitably five to twenty micrometers in width. They extend for much of the length of the blade and are located, as will be further illustrated; to permit removal of lithographically patterned mold material utilized during electroforming of the blade structure. The blade is a relatively large component of the micro-relay, and it is positioned closely spaced over the actuator and the electrical contact, all on the insulated substrate. The blade is sized so that the slots permit removal of process materials without adversely affecting the current-carrying capacity of the relay.

While the subject micro-relay design successfully satisfies the functional and size requirements of the device, it is preferred to include an arc suppression circuit on the substrate with the relay to preserve its contact surfaces from premature attrition. The arc suppression circuit is adapted to connect to the load just before the relay closes and to disconnect from the load just after the relay opens. Combining an arc suppression circuit with a micro-relay allows non-arcing switching and increases the number of cycles that the relay can operate. The micro-relay and the arc suppression circuit should be in the same package either in the same chip or in separated chips to form an integrated relay.

These and other objects and advantages of the invention will become more apparent from a detailed description of the invention which follows. Reference will be had to the drawings. It is to be recognized that the drawing figures are not drawn to scale. For example the relay blade member (member 12 in FIGS. 1A and 1B) in the specific examples has a length that is about 200 times its thickness and a width that is about 100 times its thickness. The proportions of some drawing elements are exaggerated for illustration.

DESCRIPTION OF THE PREFERRED EMBODIMENT

Figure 1A:
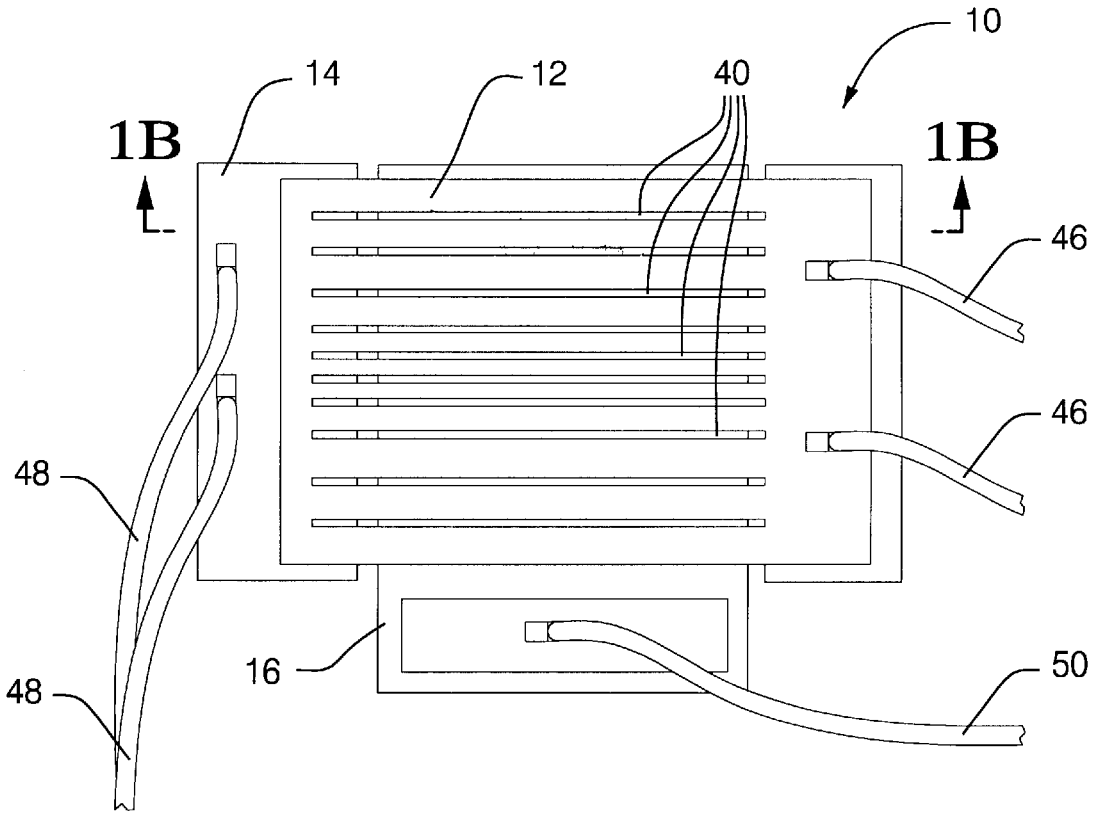
FIG. 1A is a plan view of one embodiment of a micro-relay of this invention.
Figure 1B:
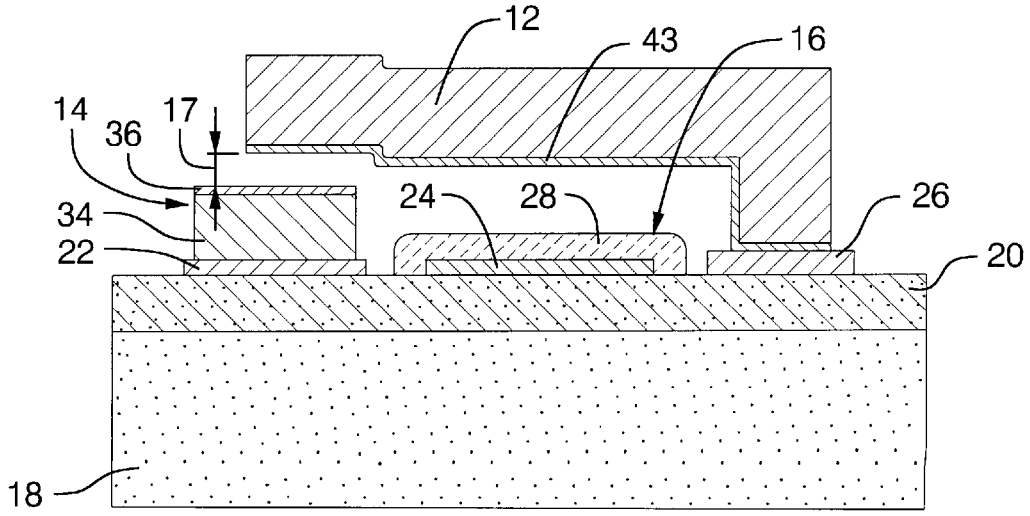
FIG. 1B is a cross section of the micro-relay of FIG. 1A taken at section 1B—1B of FIG. 1A.

FIG. 1A is a plan view of a finished and wire bonded all-metal micro-relay 10. FIG. 1B shows a cross-sectional view of the relay 10. The current carrying blade 12 is cantilevered and separated from the lower contact 14 by an air gap 17. It is a normally "open" relay. When there is a voltage difference between the actuator 16 and the blade 12, the attraction force produced by the voltage difference bends down the blade 12. Parallel conductor wires 46 are bonded to blade 12, parallel conductor wires 48 are bonded to stationary contact 14 and conductor wire 50 is bonded to actuator 16.

The strength of the attraction force depends on the voltage difference and the air gap 17 between relay blade 12 and actuator 16. Unlike the transistor operation, the polarity of the applied voltage to the relay 10 is not important. For convenience, the blade 12 of the relay is kept at the reference potential, the ground potential. Once the blade bends, the restoring force of the cantilever would bring the blade back. The blade will rest at the position where the two forces balance each other. When the attraction force is increased by increasing the voltage between the blade 12 and actuator 16, the blade will continue bending and then snap down to make a contact. This is because the attraction force is dependent more on the blade movement than the restoring force. To be specific, the electric attraction force is inversely proportional to the one and a half power of the blade movement while the restoring force is a linear function of the movement. The blade movement will reach a point where the attraction force will increase faster than the increase of the restoring force. At that point, further increase in actuation voltage will snap the blade down so that it touches the lower contact. Exceeding the snap down voltage would make a better contact and reduce the contact resistance until further deformation of the blade cannot take place. In the following sections, the structure, process sequences, lithographic mask layout and preliminary evaluation of the fabricated relays are described.

I. Process Sequences

Before going into process details, two things should be mentioned. First, the fabricated relays are electrically isolated from their supporting substrate, a silicon wafer 18. Second, the metal structure of the relay is built by electroforming. The electroforming relies on the selection of a suitable plating seed material having an oxide that is a good conductor or a material that oxidizes in air very slowly. Gold and tungsten were chosen for this purpose. Major fabrication steps are illustrated in FIGS. 2A–2H and described as follows:

1. A thermally grown silicon dioxide layer 20 is formed on the silicon substrate 18 to electrically isolate the substrate 18 from the relay elements to be formed on it.

2. The actuator pad 24 is formed as well as anchor areas, 22 and 26, for deposition of the lower contact and the blade of the relay.

Figure 2A:
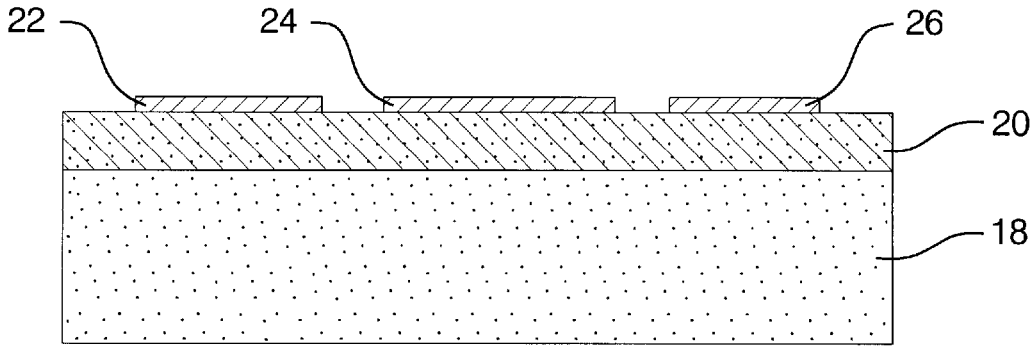
FIG. 2A is a cross sectional view showing an initial one of a succession of processing steps shown in FIGS. 2A through 2H in making the micro-relay illustrated in FIGS. 1A and 1B.

Lithographically patterned islands serve as the plating bases 22 and 26 respectively for the lower contact 14 and blade 12 of the relay 10. Before sputter depositing a thin layer of gold on the thermally oxidized silicon wafer, a layer of Ti—W was blanket deposited on the silicon dioxide to serve as an adhesion promoter for the gold. Both Ti—W and Au films were sputter deposited in the same equipment without breaking the vacuum. The films were patterned with standard lithographic techniques to form Au on Ti—W (Au/Ti—W) islands 22, 24 and 26 as shown in FIG. 2A. Typical thicknesses are 0.07 and 0.18 micrometers ($\mu$m) for Ti—W and Au films, respectively.

3. A layer 28 of silicon nitride is then deposited to cover the actuator 24.

Figure 2B:
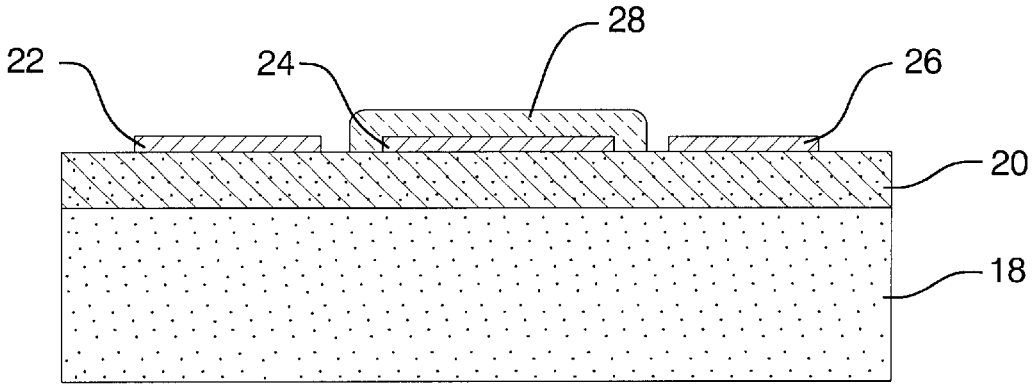
FIG. 2B is a cross-sectional view showing a step of making the micro-relay illustrated in FIGS. 1A and 1B in which a layer of silicon nitride is deposited to cover an actuator.

Silicon nitride is used to electrically isolate the actuator pad 24 from the top blade 12 even when the blade 12 is bending down to make an electrical contact with the underlying electrode (contact 14 in FIG. 1B). This nitride layer 28 was deposited by a plasma-enhanced chemical vapor deposition (PECVD) method at a temperature of ~300° C. followed by a nitride patterning as shown in FIG. 2B. The nitride deposition temperature was the highest temperature used in the relay process. It is done intentionally to keep the relay process temperatures low; namely, below 500° C. This is because it is desirable to integrate the relay 10 with control circuits (including an arc suppression circuit) to expand the relay applications. The control circuits should be fabricated onto the silicon before building the relays. It is advantageous to keep the relay process temperatures low and not to change or ruin the on-chip circuit functions. The nitride should be thick enough to sustain the actuation voltage and thin enough to prevent it from peeling off the underneath of Au/Ti—W film 24. Intrinsic tensile stress in a thick deposited nitride film could be very high, hence peeling could be a problem. Typical nitride thickness is 0.15 μm.

4. Forming a mold or opening electroplating windows at the lower contact areas.

Figure 2C:
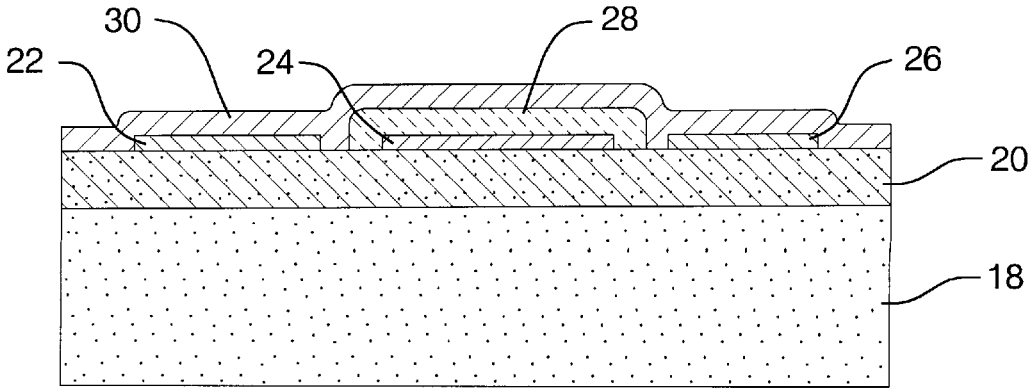
FIG. 2C is a cross-sectional view showing a further step in making the micro-relay illustrated in FIGS. 1A and 1B, in which the lower contact areas are connected with aluminum over tungsten film.
Figure 2D:
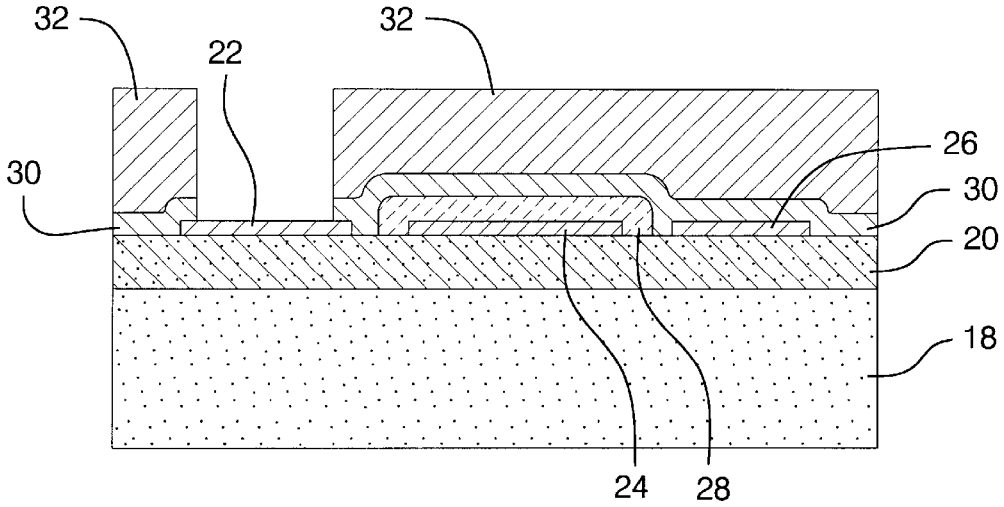
FIG. 2D is a cross-sectional view showing a still further step in making the micro-relay illustrated in FIGS. 1A and 1B, in which a lower contact area is exposed.

The plating cathode was formed by connecting all the lower contact areas (Au on Ti—W islands) with aluminum over tungsten film. Both film layers were deposited in vacuum systems. As shown in FIG. 2C, layer 30 represents the combined aluminum over tungsten film. Typical thicknesses for aluminum and tungsten are 1 and 0.1 μm, respectively. A thick (~10 μm) mold 32 of photoresist AZ4620 was spun on top of the Al/W film 30. After patterning the mold and etching, the lower contact area 22 of the relay 10 was exposed as shown in FIG. 2D. The wafer is then ready for electroplating of the copper electrode post 34.

5. Electroplating copper followed by gold or silver plating.

Figure 2E:
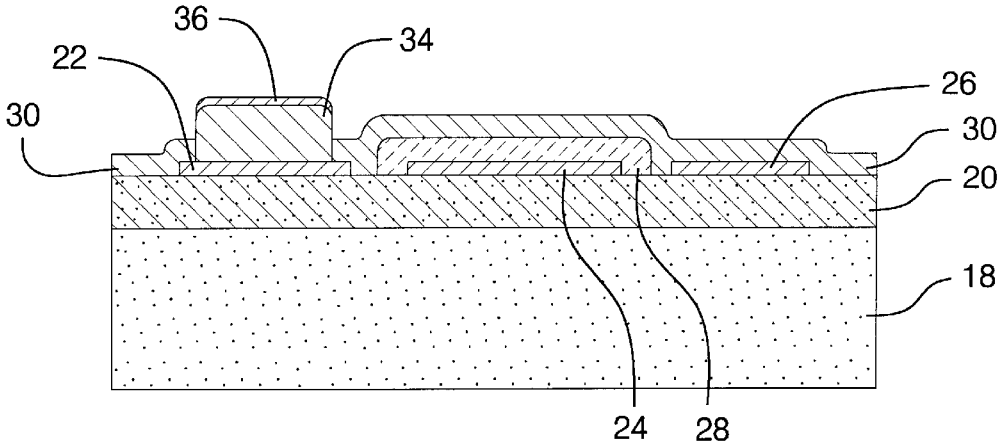
FIG. 2E is a cross-sectional view showing a later step in making the micro-relay illustrated in FIGS. 1A and 1B, in which a copper post and plating on the post are added.

A copper post 34 was electroplated on Au/Ti—W island 22 followed by a gold (or silver) plating 36 on the copper post 34 through the opened area of mold 32. The mold 32 was removed afterward. Typical plated copper 34 and Au (or Ag) 36 thicknesses were 5 and 0.1 μm, respectively, as shown in FIG. 2E. After removing the mold, there was a choice to keep or remove the connecting part of the cathode material, aluminum on tungsten (Al/W) films 30. For illustration purposes, it is assumed that the Al/W films were kept. The films served two purposes. First, they were used to electrically connect all the plating seed areas. Second, they served as a portion of the sacrificial layer on which the relay blade 12 will be built.

6. Coating wafer with photoresist to add the sacrificial blade electroforming support layer to its desired thickness.

Figure 2F:
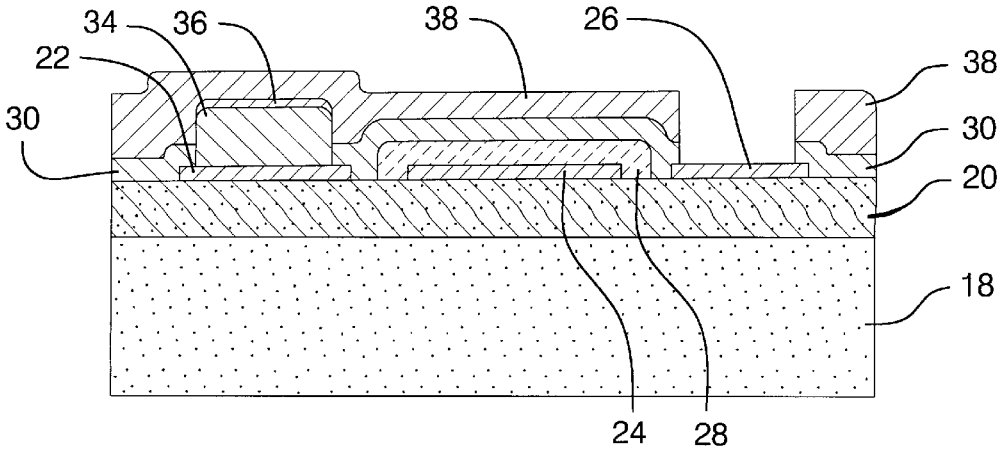
FIG. 2F is a cross-sectional view showing a still later step in making the micro-relay illustrated in FIGS. 1A and 1B, in which a photoresist coating is applied.

Photoresist 38 was spun on the wafer. After patterning the photoresist sacrificial layer, the Al/W film on top of the anchor base 26 was etched away as shown in FIG. 2F. The resist is then "hard" baked at a temperature slightly higher than its normal post-bake temperature. For example, when the positive working photoresist AZ1818 was used, the hard baked temperatures used were in the 130–160° C. range. As shown in FIG. 2F, it is important to point out that there were two sacrificial layer thicknesses 30 and 38. The thickness of 38 on top of the lower contact area 34 is thinner than the thickness on top of the actuator cover area 28 which has two sacrificial layers; layer 30 and 38.

7. Preparing for the plating cathode.

Figure 2G:
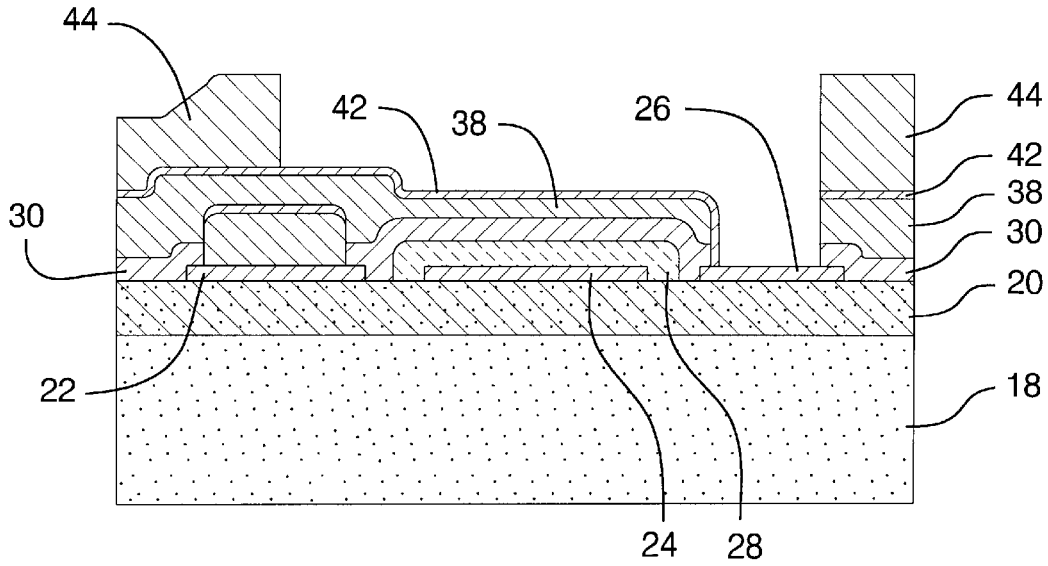
FIG. 2G is a cross-sectional view showing a next step in making the micro-relay illustrated in FIGS. 1A and 1B, in which a tungsten layer is deposited.

To prepare for the top blade 12 plating, a tungsten layer 42 was sputter deposited on top of the patterned hard baked photoresist 38. The wafer was patterned to have the tungsten layer on top of the anchor base 26 removed and have the gold on 26 exposed. Then a thick photoresist mold 44 was spun coated and patterned as shown in FIG. 2G. Although not shown in the specific cross section of FIG. 2G, the pattern of the photoresist material 44 also defines ten slots 40 (FIG. 1A) each about 1.2 mm long, about 20 μm wide and spaced about 80 μm apart. These slots, which become a permanent part of the blade 12, are critical to the making of the relay.

8. Electroplating the top blade 12.

Figure 2H:
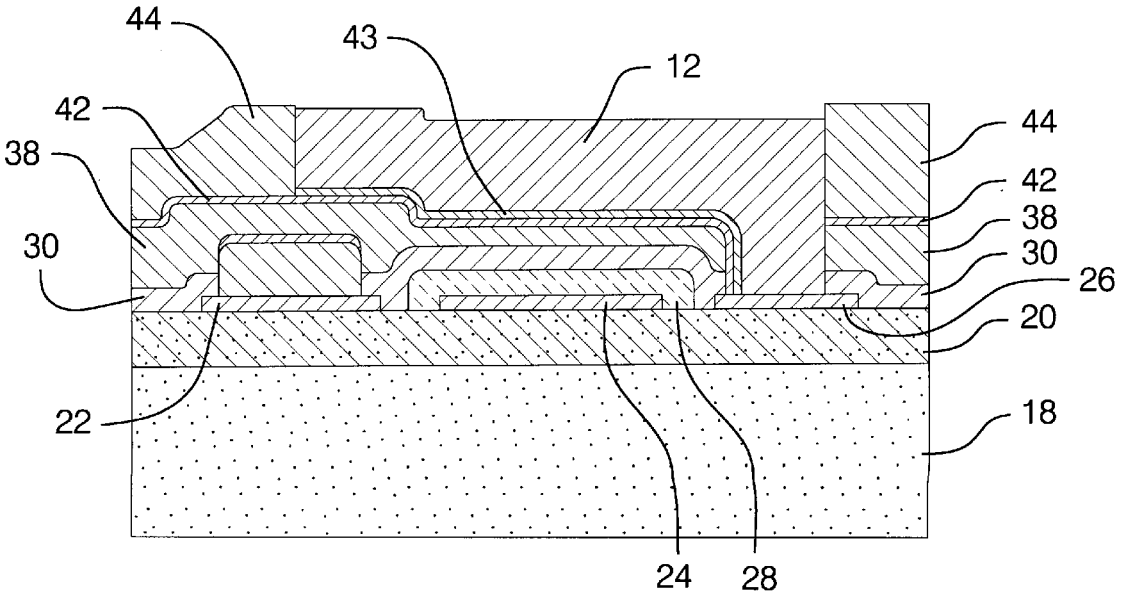
FIG. 2H is a cross-sectional view showing the micro-relay illustrated in FIGS. 1A and 1B completely fabricated.

A thin layer of gold (or silver) layer 43, was plated followed by the copper electroforming of blade 12 as shown in FIG. 2H. Typical thicknesses were 0.1 and 10 μm for Au (or Ag) and Cu, respectively. At this point, the relay structure was completely fabricated. The blade 12 was "bonded" to the lower contact 14 by the sacrificial layers 30 and 42. Dicing the wafer into individual chips and releasing the relay blade will finish the relay fabrication.

9. Releasing the relay structure.

To efficiently remove the thick plating mold and the top portion of the sacrificial layer, the wafer was exposed to UV light before soaking into a photoresist remover. An etchant was then used to chemically remove the bottom part of the sacrificial layers—tungsten and aluminum films—without damaging copper, gold, silver, silicon nitride and silicon dioxide. In this release process the slots 40 in blade 12 facilitated the flow of photoresist remover and etchant in removing the sacrificial layers. In fact, the provision of the slots 40 in the long, wide and very thin blade 12 is considered essential to the efficient and practical manufacture of the relay 10.

The released relay structure 10 is shown in FIGS. 1A and 1B.

II. Relay With Recessed Contact Layer

Figure 3:
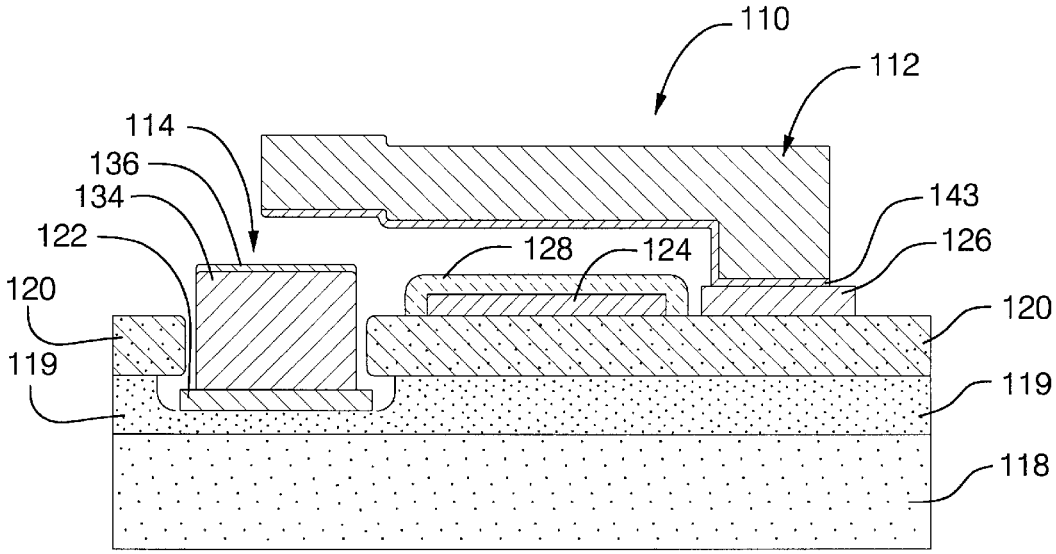
FIG. 3 is a sectional view of a different embodiment of the micro-relay shown in FIG. 1B.

A variation of the FIGS. 1A/1B relay structure and its fabrication steps are described below. In this variation (referring to FIG. 3), the contact 134 of the relay 110 is recessed below the top surface of the $SiO_2$ insulative layer 120 to allow a flatter blade 112 structure. The cross-sectional view of the structure is shown in FIG. 3. In FIG. 3 elements of the relay 110 that correspond to the relay 10 depicted in FIG. 1B are identified by the same last two digits in the reference number.

Because of the ~5 μm step of the lower contact, it is very likely that the thickness of the photoresist 38 above the edges of the lower contact is thinner than other regions (FIG. 1). The resulting gap at the inner side of the lower contact may be narrower than that of the rest of gap. This may cause an uneven contact when the relay is at its closed position. This, in turn, may result in a higher contact resistance and a higher current concentration at the smaller contact area. This non-ideal situation can be minimized by recessing the contact electrode 114 (FIG. 3) and modifying fabrication steps.

These steps are described as follows with reference to FIGS. 4A–4D and FIGS. 5A and 5B:

(a) Selectively dope and drive in the dopant to form an n- or p-type conductive region 119 in silicon substrate 118 at the contact pad 114 area.

Very high concentration of boron ($p^{++}$ for an n-type substrate such as n-type silicon) or phosphorus ($n^{++}$ for a p-type substrate) may be selectively doped at the designated lower contact regions and the regions needed to connect them. It is followed by a high temperature diffusion to form a heavily doped layer 119 slightly deeper than 4 μm in silicon 118 (or 5 μm when measured from the wafer surface). The high temperature diffusion step has to be done in conjunction with the fabrication of the on-chip control circuits before building the relay.

(b) Prepare for the lower contact area.

Figure 4A:
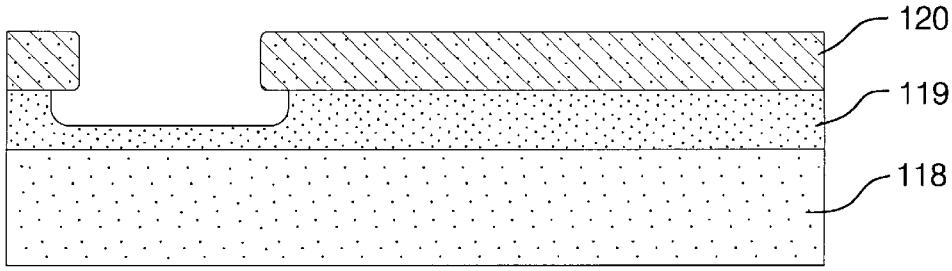
FIG. 4A is a cross-sectional view showing an initial one of a succession of processing steps shown in FIGS. 4A through 4D in making the micro-relay structure shown in FIG. 3.

Isotropically etch the heavily doped lower contact regions 119 to a depth slightly shallower than 5 μm (measured from the surface of $SiO_2$ layer 120). For example, when a 1 μm thick silicon dioxide was used as a mask to etch the regions, 4% $NH_4F+HNO_3$ solution was used to etch silicon and form an undercut as shown in FIG. 4A. The undercut is needed for a clean lift-off metallization.

(c) Coat photoresist 121 and pattern the photoresist to prepare for the metal lift-off.

Figure 4B:
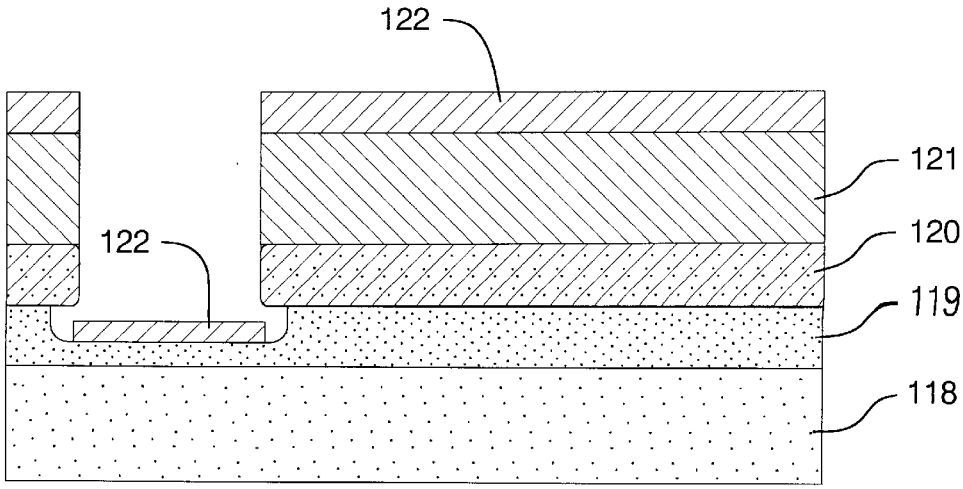
FIG. 4B is a cross-sectional view showing a further step in making the micro-relay structure illustrated in FIG. 3.
Figure 4C:
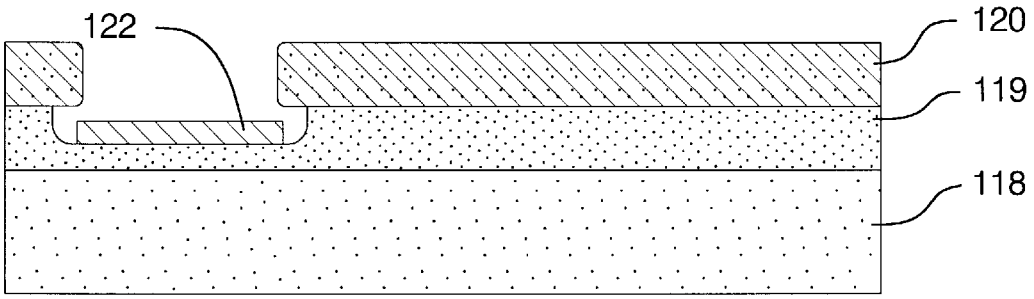
FIG. 4C is a cross-sectional view showing a still further step in making the micro-relay structure illustrated in FIG. 3.

(d) Sputter deposit Ti—W followed by an Au deposition 122 as shown in FIG. 4B and then dissolve the photoresist and lift off unwanted Au/Ti—W films as shown in FIG. 4C.

Figure 4D:
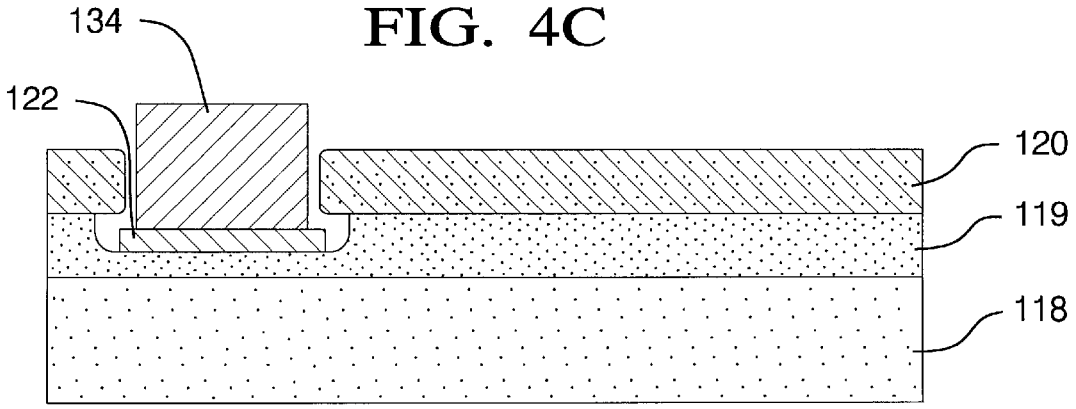
FIG. 4D is a cross-sectional view showing a final step in the succession of processing steps in making the micro-relay structure illustrated in FIG. 3.
Figure 5A:
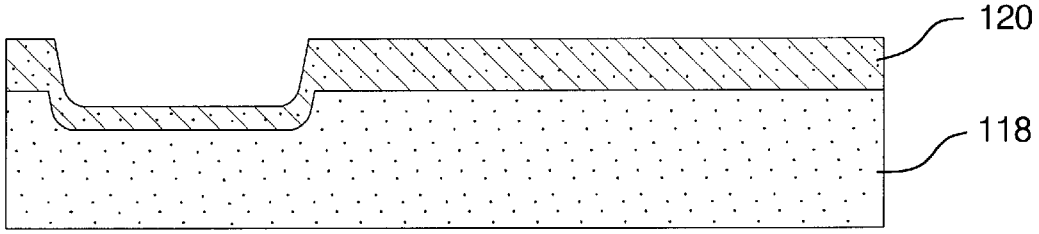
FIG. 5A is a cross-sectional view showing a processing step in making many of the micro-relay structures illustrated in FIG. 3.
Figure 5B:
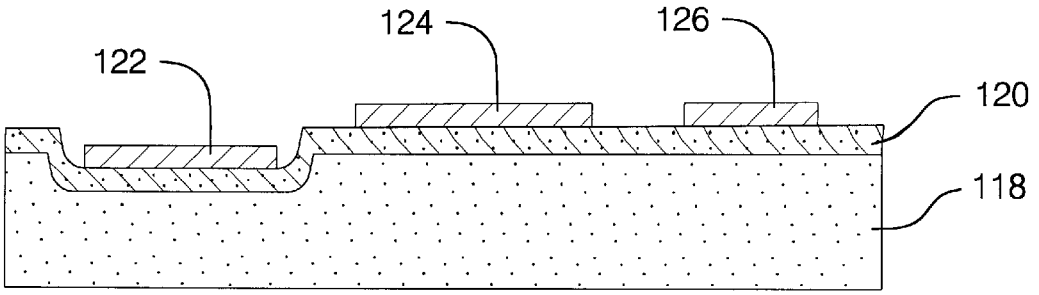
FIG. 5B is a cross-sectional view showing a later step in making many of the micro-relay structures illustrated in FIG. 3.

(e) Electroplate copper 134 slightly thicker than 5 μm to have copper surface above the surface of the silicon nitride-covered actuator (to be built in the later step) as shown in FIG. 4D.

(f) Define other two plating bases, anchor 126 (for the blade) and actuator 116 (see FIG. 3), as was described earlier (step 2 in the "Process Sequences" section).

The other way to make a recessed lower contact is to form recess regions at the places where the lower contacts will be built. It was done by etching the silicon substrate at the areas for the lower contacts before step 1 of the Process Sequences section. Therefore, the wafer will look like FIGS. 5A and 5B before and after putting the plating base for the relay.

III. Device Dimensions

The physical dimension of the relay is determined by its operation specifications; mainly, current carrying capacity and actuation voltage. In the following illustration example, a 2 A copper relay actuatable at 12V is proposed. Copper thin film (e.g., 10 μm thick) can dissipate heat very efficiently and is capable of carrying a higher current density than the copper buses. The current carrying capacity of a copper thin film is not limited by the temperature rise produced by the current. It is limited by electromigration. Current density as high as $10^5$A/cm$^2$ has been measured in copper films, which is $10^3$ times larger than that of the copper buses. To be safe, a lower value of $10^4$ A/cm$^2$ may be used for micro-relay design purposes.

The thickness of the relay blade 12 is limited by the plating mold thickness. The mold thickness that could reliably be made and patterned with equipment used in this work was thinner than 25 μm. For convenience and good reproducibility, a 15 μm mold was used to make a 10 μm copper blade. A 10 μm thick copper blade, carrying one to two amperes of current requires a width of about 1 mm. The length of the blade will be determined by the available or required actuation voltage.

Empirically, the required actuation voltage V,C at which the top blade will snap to close the contact is:

$$V^2_{ac} \sim 3E\ d^3\ t^3/(10\ \epsilon_0 L^4)$$

where E, t, and L are Young's modulus, thickness and length of the top copper blade, respectively. The "d" is the separation between the top blade and the actuator and $\epsilon_0$ is the permittivity of air. Assuming the copper thin film has the same Young's modulus as the solid copper and ignoring silicon nitride, a 12V actuation voltage to a 3 μm gap relay can snap a 718 μm beam to its closed position. As shown in the equation, the longer the beam, the easier the actuation. However, other factors can change the actuation voltage, too. To anticipate the situations such as lower battery voltage and tensile stress in the electroformed copper beam, relays with a beam length of 1.9 mm were made. Lower battery voltage can be caused by a number of electrical system variables. As a precaution, a voltage regulated charge pump circuit should be used to maintain the necessary actuation voltage in spite of a low battery voltage.

During the relay structure release step, the supporting materials underneath the blade 12 were dissolved. Processing chemicals require access holes or slots to effectively reach the sacrificial layers under the relatively wide and long blade structure. Without access holes or slots, only the material at the relay edges would be exposed to the chemicals for etching. Therefore, etch slots and holes are part of the pattern on the top blade to expose the sacrificial materials to the chemicals. The chemical access slots 40 can be seen, e.g., in FIG. 1A.

IV. Process Considerations

In the process section, it was assumed that the 1 μm of aluminum on tungsten (Al/W) films, films 30 (in FIGS. 2C–2H) were kept after the lower contact had been made. This resulted in two sacrificial layer thicknesses under the blade. After removing the sacrificial layer, the air gap on top of the actuator 16 will be 1 μm larger than that on top of the contact 14. When the actuation voltage was applied to make a contact, the blade 12 would touch the contact 14 before it can touch the actuator 16. If the blade is flexible enough, the blade can move down further at the actuator area. At the same time, it also allows the blade at the contact area to slide and wipe dirt or thin oxide films off the contact to make a firmer and better contact there. The "over-traveling" of the blade is a common practice in mechanical relay operations. If the blade is very rigid such that the blade is stopped by the lower contact, then the blade will not touch the silicon nitride on the actuator. The actuation voltage will be shared by the air gap and the silicon nitride film. Since air is a good insulator, this will allow a higher voltage to be applied to the actuator. The air gap is even more beneficial if there are defects in the nitride film.

If the 1 μm Al/W films 30 were etched after the lower contact was made, new Al/W films are blanket deposited followed by the photoresist sacrificial layer coating. In this way, the gap between the blade either to the lower contact or to the actuator will be the same. This is to show that the gap on top of the actuator can be adjusted to equal to or larger than the gap on top of the lower contact in the final device. The difference of these two gaps, or the blade overtraveling distance, is adjusted by the Al/W thickness. In other words, the 1 μm thickness of the Al on W film mentioned in step 4 is an adjustable process parameter.

Tungsten was used in the process to serve as an electric connect for the plating because its oxide is a reasonably good conductor. In additional to tungsten, chromium is an alternative for the same purpose. One of the difficulties encountered during the process is caused by the porosity of the tungsten film. It is unreliable to use the tungsten film as an effective etch stopper. For example, in step 7 of the process sequence section, the tungsten film is patterned. During the patterning, the materials on top and underneath the tungsten film are photoresists. When the developer, AZ400K, is used to wash out the exposed positive photoresist on top of the tungsten film, it is very important to accurately control the developing time. This is because the developer can penetrate through the porous tungsten film and start to attack the underneath photoresist, the hard baked resist, if the developing time is too long.

In step 8 of the process section, a thin layer of gold was electroplated on top of the sputtered tungsten film before the final copper blade plating. Because of the very good adhesion between tungsten and gold, tungsten will stay at the bottom of the top blade after the blade is released (step 9). It is very important to etch away the tungsten film to have a low relay contact resistance. One alternative to replace the sputter-deposited tungsten as the plating seed is to evaporate a thin layer of copper in step 7. This thin copper seed layer can be removed with a chemical etching after dissolving the hard baked sacrificial layer photoresist.

After exposure in air for a long time, copper will form enough copper oxides to increase the relay contact resistance undesirably. It would be better to seal the copper, at least at the contact region, with a good conductive and chemically inert material, such as gold or silver. This is the reason that gold was electroplated on top of the lower contact as well as at the bottom side of the upper blade.

It is very important to keep the wafer surface clean. Copper polishing chemicals, such as diluted sulfuric acid, should be used to clean up the residues on the wafer and on the relays. If there were residues on the wafer surface, it is likely that the residues could connect the actuation terminal to the blade and create leakage current paths.

V. Other Relay Embodiments

Relays with two different structures were built, cantilever and bridge. One major advantage of using the cantilever structure is that it needs only one contact to complete the electric connection. This reduces the overall "on" resistance of a relay. To adjust the required actuation voltage, cantilever structure relays with three different dimensions were made. These variations are described as follows. Plan views of finished relays on silicon substrates, three cantilever structured relays and one bridge structured relay, are shown in FIGS. 1A (shorter cantilever), 7 (longer cantilever), 8 (dual actuators) and 6 (bridge contact), respectively.

Figure 6A:
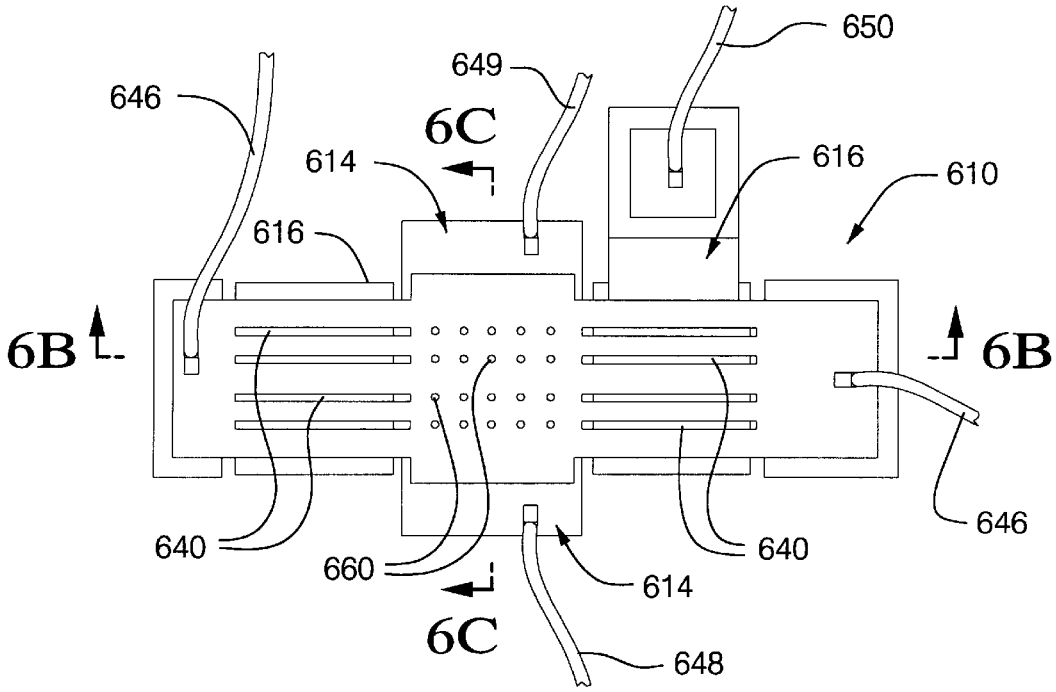
FIG. 6A is a plan view of a bridge relay structure.
Figure 6B:
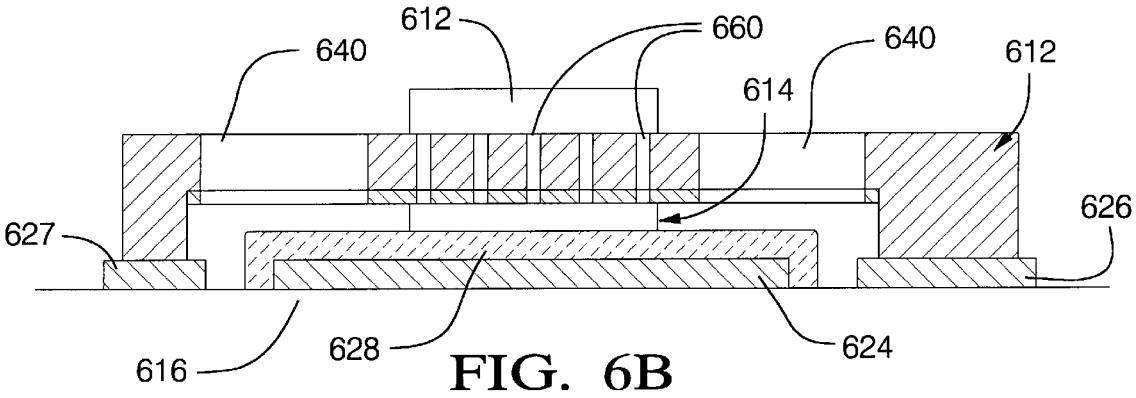
FIG. 6B is a sectional view taken on the line 6B—6B in FIG. 6A.
Figure 6C:
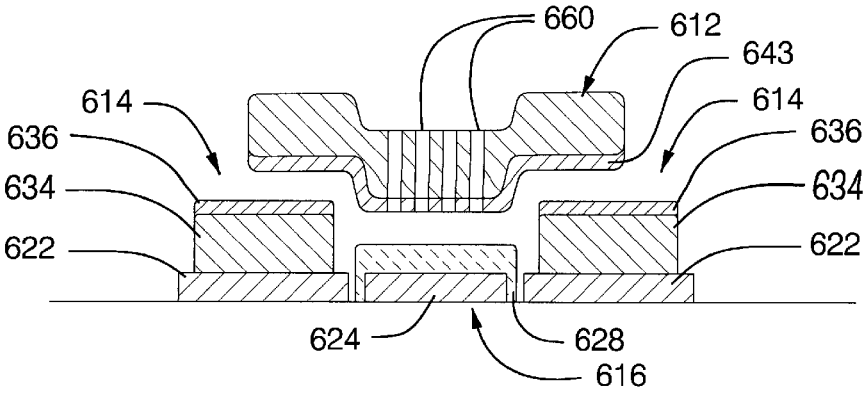
FIG. 6C is a sectional view taken on the line 6C—6C in FIG. 6A.
Figure 7:
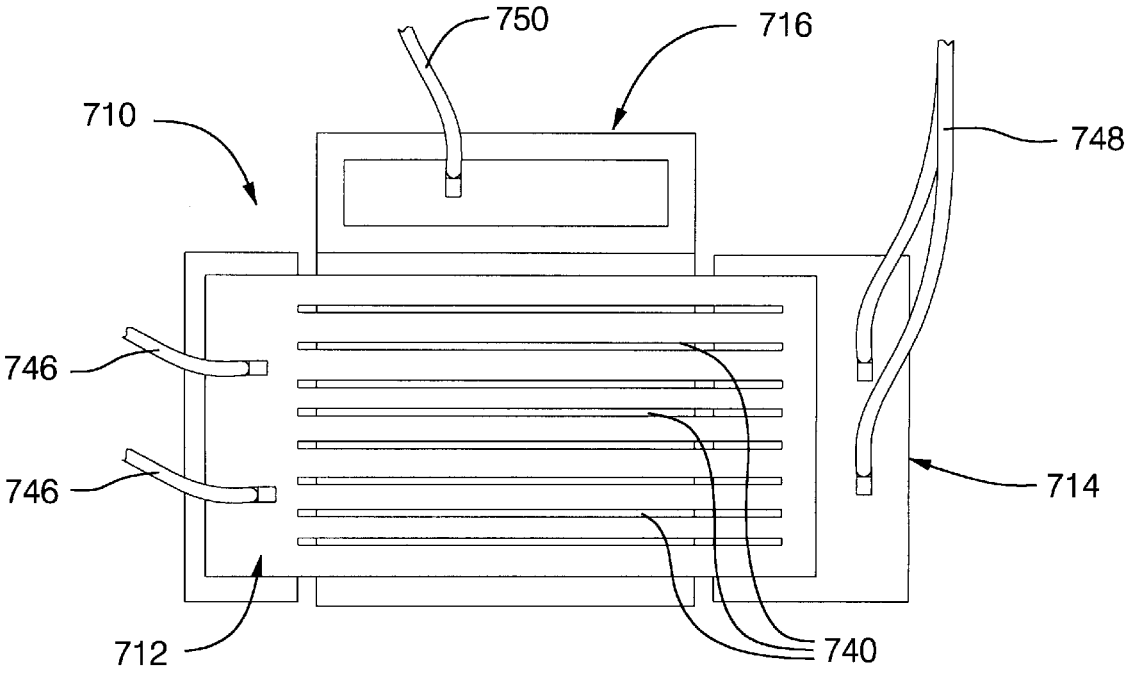
FIG. 7 is a plan view of a cantilever relay structure with a blade length of 1.9 mm and a longer actuator member than the relay shown in FIG. 1A.
Figure 8:
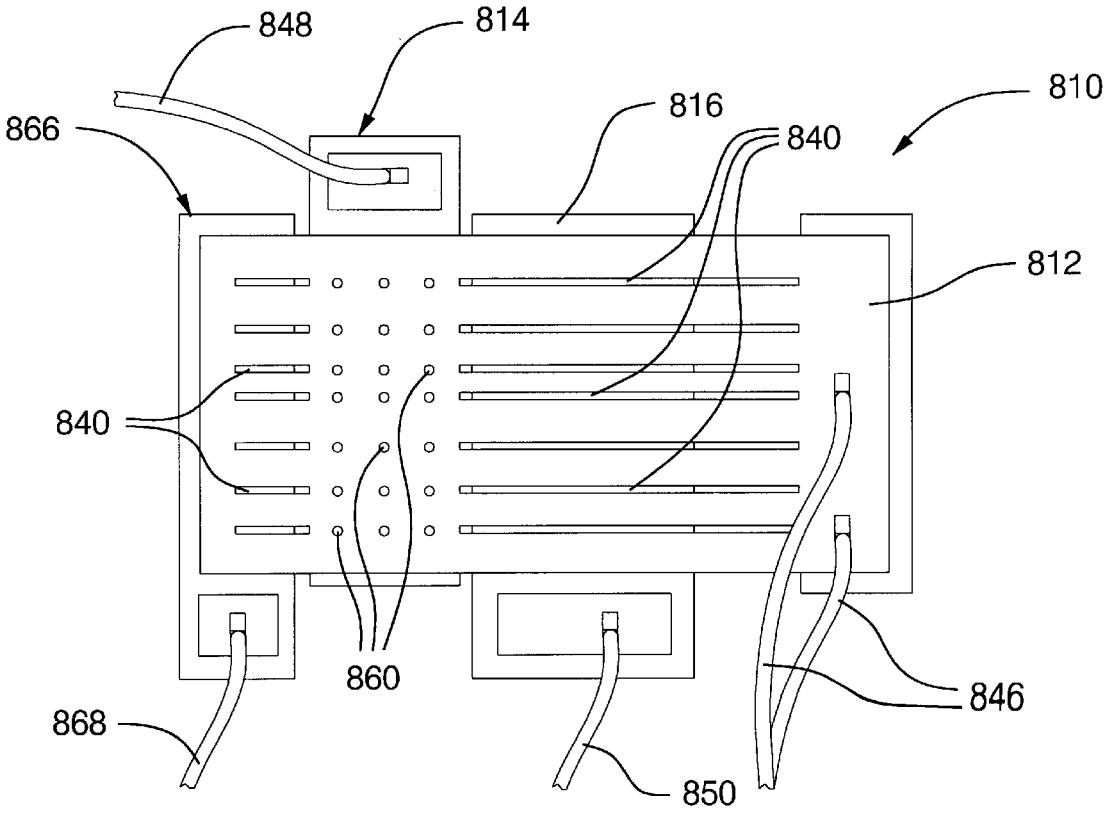
FIG. 8 shows a cantilever relay structure with a blade length of 2.2 mm and two actuators.

FIG. 1A illustrates a cantilever micro-relay structure, already described, with a relatively short blade length of 1.3 millimeters. FIG. 7 depicts in plan view a cantilever relay structure with a blade length of 1.9 mm and a longer actuator member than the relay shown in FIG. 1A. FIG. 8 shows a cantilever relay structure with a blade length of 2.2 mm and two actuators. FIGS. 6A–6C show a bridge relay structure with a blade length of 1.8 mm. As was mentioned previously, the chemical access slots (lines) and holes (dots) on each relay blade are shown in this diagram.

1. Cantilever Structure

In an electrostatically-actuated cantilever structure, the magnitude of the actuation voltage depends on its geometrical dimensions and structure material. Two blade lengths were used, two longer blades (FIGS. 7 and 8) and one shorter blade (FIGS. 1A and 1B).

FIG. 7 illustrates one embodiment of a longer blade micro-relay, as compared to the FIG. 1A relay. Micro-relay 710 utilizes a blade 712 length of 1.9 mm (width 1 mm and thickness 0.01 mm) as compared to a blade 12 length of 1.3 mm in the FIG. 1A micro-relay. Actuator 716 is also proportionately longer, 0.5 mm longer than actuator 16. Otherwise, the FIG. 7 relay is the same is the FIG. 1A relay, and the corresponding parts of the FIG. 7 relay are similarly numbered in the last two digits. The longer blade 712 and longer actuator 716 permit the use of a lower actuation voltage.

FIG. 8 illustrates another long blade 812 micro-relay 810 using actuators 816 and 866 split into two locations—on both sides of the contact member 814. The length and the location of the split actuators 816 and 866 were chosen such that both actuators would produce enough attraction force to make an even contact between blade 812 and contact 814 to promote more contact area than using a single actuator. In addition to slots 840, blade 810 also is provided with holes 860 in the blade area overlying contact 814. Like the slots 840, some 40 holes 860, each about 20 $\mu$m square, enable better circulation of mold and sacrificial layer removing fluids during manufacture of the relay without unduly reducing electrical conductivity in blade 812.

2. Bridge Structure (FIGS. 6A–6C)

The force required to bend the blade down is proportional to the stiffness of the blade structure. To increase the stiffness of a beam, a bridge structure is used. Hence, the bridge structure is designed with a high actuation voltage in mind. For example, the bridge relay can be used to trigger a bypass circuit when a high voltage is present in the line. Major drawbacks of the bridge relay are the inherent temperature sensitivity and smaller contact area than a cantilever relay. The stress generated within the clamped-clamped blade due to temperature change could change the actuation voltage significantly. Because of the clamped-clamped structure, the contact area has to be between the two clamped areas. The deflection profile of the top blade might prohibit having a long flat contact area to the bottom contacts.

In the bridge design, two blade profiles were considered. One was to have the blade bow up in the middle (to accommodate the height of the lower contact and to keep a constant air gap) and the other was to bow out sideways (wing structure). It would be better to have a built-in stress relief structure or a bow up structure. However, to produce the attraction force more effectively, the area under the center of the bridge should be used for actuator. This consideration excludes the bow up structure. The penalty for the wing shape blade is it requires two contacts to complete the electrical connection resulting to a higher overall relay electrical resistance. Because of the concern that a high actuation voltage could cause the air breakdown before the relay blade snaps down and makes a contact, lower actuation voltage for the bridge structure supersedes the contact resistance concern. The side wing shape is adapted for the design.

As shown in FIGS. 6A through 6C, the bridge relay 610 has a blade 612 cross section with a "wing" profile (FIG. 6B). The blade 612 of the bridge relay (top and bottom slabs of the "dotted" center square) on top of the two contact terminals is raised by the height of the lower contact 614. The "dots" 660 in the center square area and the "slots" 640 at both sides of the square of the bridge relay are the chemical access holes. As seen in FIG. 6B, actuator 616 extends along much of the length of bridge blade 612. There are two contact pads 614, one on either side of actuator 616. Conductor wires 648 and 649 are bonded to the two separated contact pads, respectively.

As shown in FIGS. 1A, 6A–6C, 7 and 8, slots (40, 640, 740 and 840, respectively) extend through the thickness of the metal blade of the micro-relay and for much of the length of the blade but not to or through the ends of the blade. In other words, the function of the slots and dots 660 is to provide chemical access holes in making the metal blade. It is usually preferred not to extend the slots through the end of the blade so as to divide the blade into a plurality of separated blade segments.

The examples described above were for relays suitable for carrying 2A of current load continuously. If one would like to scale up the current handling capability, the dimension of the relay should be adjusted accordingly. For example, to design a 10A micro-relay, the width and the thickness of the blade should be scaled up. If the thickness of the blade is increased from 10 to 15 $\mu$m, the width of the blade should be increased from 1 mm to 3.4 mm to accommodate the factor of 5 increase in current. In order to keep the actuation voltage in the same range as before, the length of the blade should increases; according to the empirical formula described in the device dimensions section, from 1.9 mm to 2.6 mm.

VI. Arc Suppression

The integration of the subject micro-relay with an arc suppression circuit is desirable in many switching applications. Arc suppression integration is a "must" feature for a micro-relay to switch high current loads and to prevent contact erosion by arc. A functional diagram of an integrated relay is shown in FIG. 9.

In general, a solid state arc suppressor is connected to the relay in parallel, preferably on the same silicon substrate. A known control circuit is employed that will turn on the arc suppressor, or a solid state power device, before the relay blade closes its contact and turns off the arc suppressor after the relay breaks off the contact. When used with the subject integrated micro-relay, it is the power device, the arc suppressor, that experiences the energy spikes during switchings. Because the micro-relay can physically make and break the contact in less than 60 μs, the suppressor only needs to carry the whole load current for less than 60 μs. Hence, the power rating of the suppressor does not need to be high. With an arc suppressor to shield the micro-relay from energy spike-caused damage, the number of operation cycles of the subject micro-relays in 2 to 10 ampere circuits can be increased by orders of magnitude.

Figure 9:
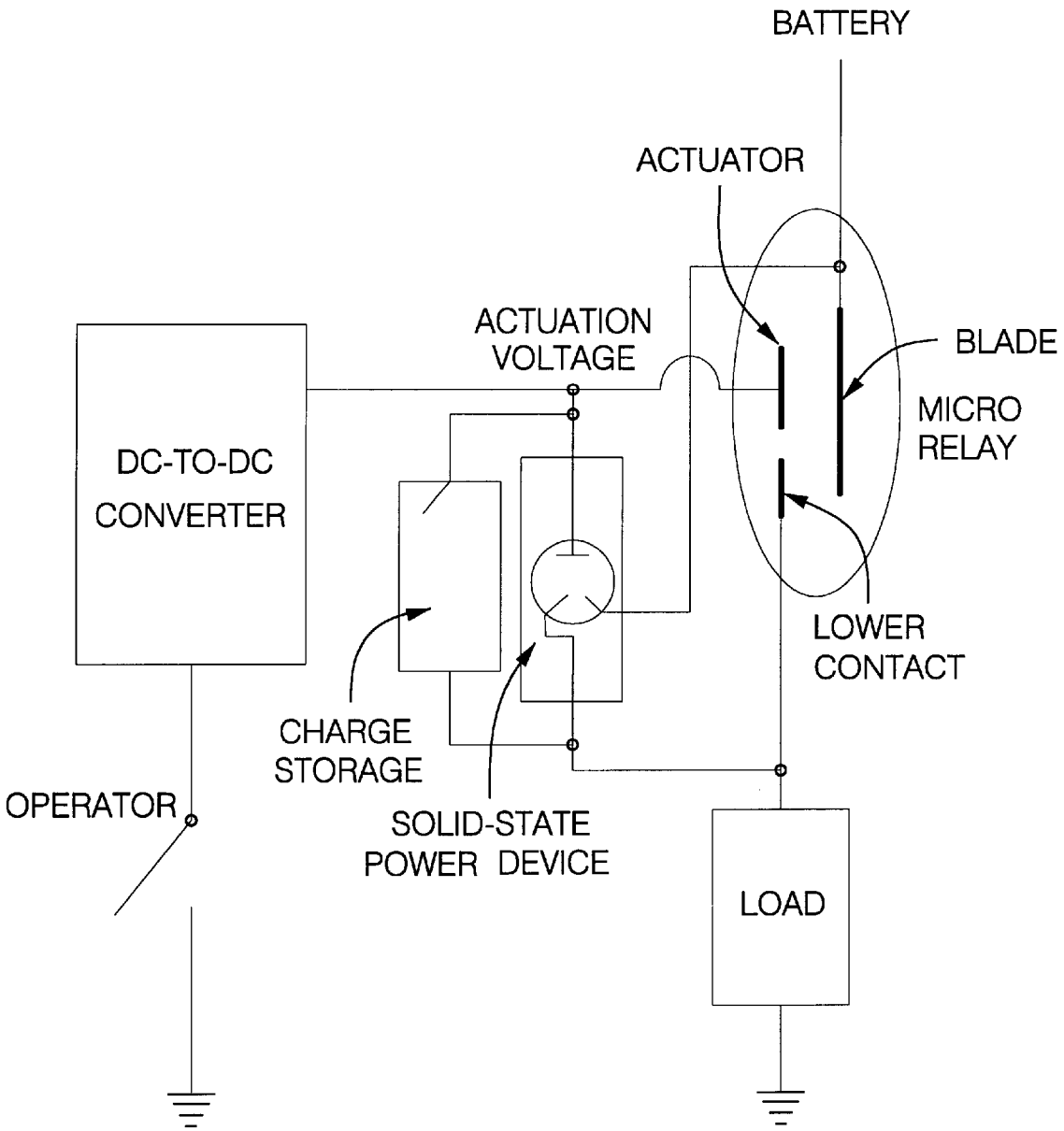
FIG. 9 is a schematic functional diagram of a micro-relay of the subject invention integrated with an arc suppression circuit and connected to a load.

Referring to FIG. 9, the relay is used as a "high-side" application which will be used in many practical applications with current rating from fractions of an ampere and up. "High side" means that the relay is not at the ground potential during operation.

The operation principle illustrated in FIG. 9 is as follows. Once the operator closes the switch, the DC-to-DC converter will start to generate the needed actuation voltage to the actuator and power up the solid-state power device. It will take a longer time to close the blade of the micro-relay than the time needed to turn on the solid-state device. The activated solid-state power device connects the battery voltage through the solid state power device to the electric load first. All the transient currents and energy spikes associated with turning on the load will be absorbed by the solid state power device. In less than 60 μs, the micro-relay will be closed and connects the battery voltage to the load, too. Since the "on" resistance of the relay is orders of magnitude lower than the resistance of the power device, most of the load current will flow through the relay when both relay and solid state device are "closed". The current through the power device will then be low such that the heat generated by the device is negligible. At this time, charges have been stored in the capacitor (not shown) of a charge storage circuit, too.

When the operator turns off the switch, the actuation voltage drops off, too. The blade will be released in less than 60 μs and breaks off the blade from the lower contact. During breaking off, the actuation force decreases and the electric resistance of the micro-relay increases dramatically, shifting the load current to the power device. This is because the designed circuit will have the stored charges leaked away slowly. These charges are used to hold the needed bias voltage (or current) and keep the power device at the "on" stage longer than the time required for the relay to break off, 60 μs. Again, it is the power device to take the transients and energy spikes when the switch is opened by the operator.

Figure 10:
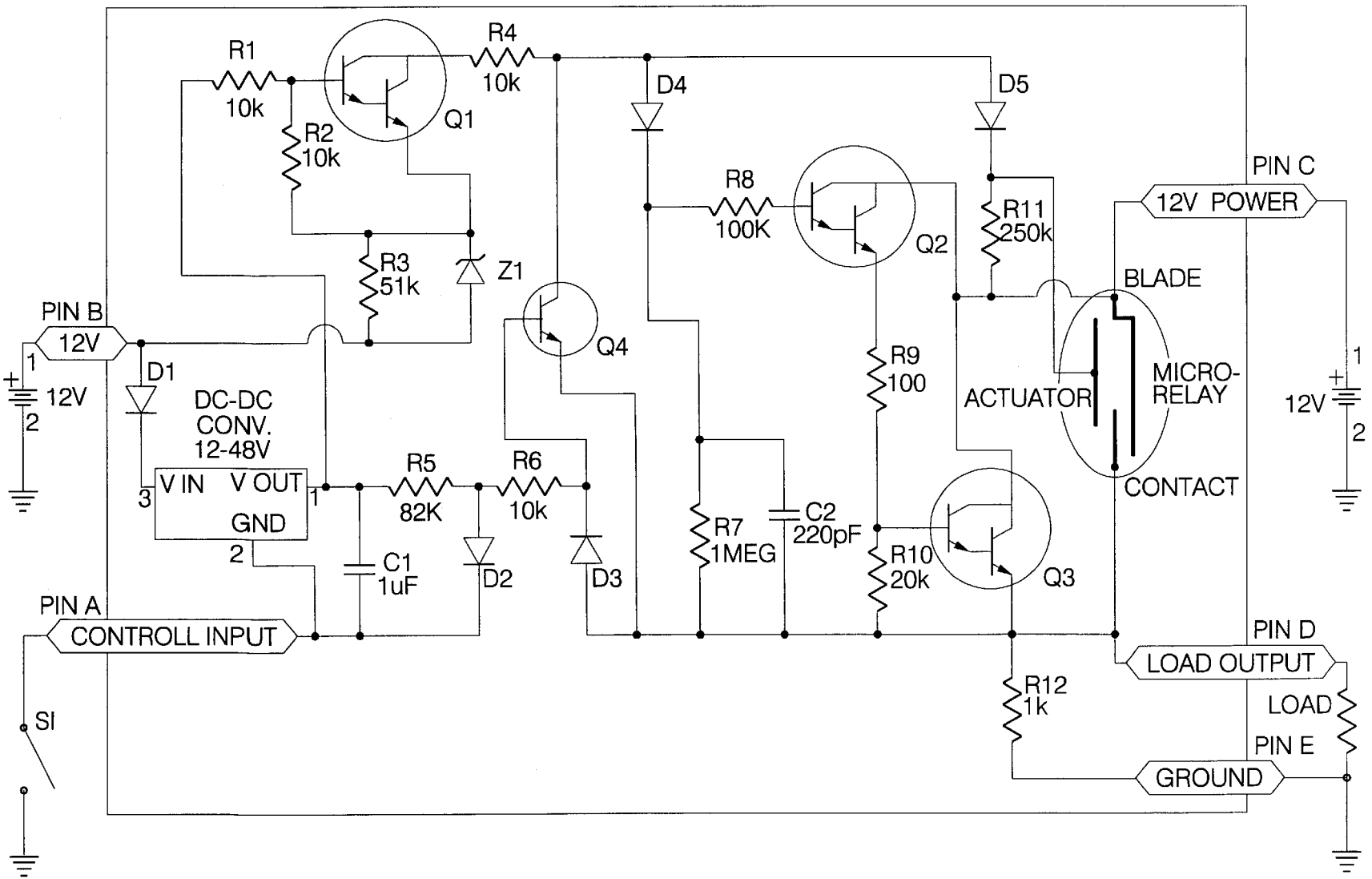
FIG. 10 is an electric circuit diagram including a micro-relay, arc suppression and load.

To put the functional block diagram into a circuit, FIG. 10 shows a suitable design of an arc suppression circuit. The Darlington transistor, Q3, is the power device parallel to the micro-relay. The capacitor C2 is the charge storage capacitor.

As shown in FIG. 10, the actuation and the arc suppression operation work as follows. When the operator has closed the command switch S1, the DC-DC converter will start to generate the output voltage. As this voltage builds up, transistor Q1 will turn on at a set actuation voltage threshold determined largely by the Zener diode Z1. At this time, the actuation voltage is applied directly to the "ACTUATOR" electrode of the Micro-Relay. Consequently, the BLADE starts to be pulled in by the electrostatic force created by the voltage differential between ACTUATOR and BLADE. As the BLADE starts to move toward the CONTACT, transistors Q2 and Q3 will turn on in sequence. Transistor Q3 turns on before the BLADE is completely pulled in and before contact bounce could occur. The closing time of the BLADE is determined by its mechanical characteristics and the electrostatic pulling force. This closing delay time could last from 30 to 100 microseconds. The BLADE closing delay time is longer than the maximum five microseconds turn-on time of Q2 and Q3, which is itself determined by the (R4)×(C2) time constant. During this turn-on delay time, the saturation voltage of Q3 is insuring that the voltage across the BLADE and the CONTACT is below the sustained arcing voltage level. This will create an arcless environment for the relay to make a contact.

At turn off, when the operator has opened the command switch S1, the output voltage of the DC-DC converter starts decaying slowly because of its output filter capacitance C1. At the threshold determined by Z1, Q1 will turn off. Transistor Q4 will turn on and immediately shunts the output of Q1 and removes the voltage differential between the ACTUATOR and BLADE. Therefore, the BLADE is released and it will open immediately. Transistor Q4 will remain in conduction until its base current is starved by the collapsing DC-DC converter output voltage. Also, after Q1 has turned off, Q2 and consequently Q3 will remain on for a turn-off delay time period determined by the discharge of the capacitor C2 through the paths of R7 and R8. During this turn-off delay time, the saturation voltage of Q3 is insuring that the voltage across the BLADE and the CONTACT is below the sustained arcing voltage level. Again, this will ensure the relay to break off a contact without arcing.

The configuration of FIG. 10 refers to a high-side load switching with a low-side control input. Only the circuit included inside the solid line is part of the integrated micro-relay. The remaining circuit is an example of automotive application.

The same circuit concept can be used in a low-side load switching configuration. The only difference in the low-side application is that the actuation voltage is no longer referenced to the 12V battery but to Ground voltage level minus the voltage drop across the micro-relay.

For different configuration applications when more than one micro-relay is packaged into one chip, the DC-DC converter can be shared by all the relays.

VII. Experimental Results

A silicon wafer was used as the starting substrate for building the relays described above. The wafer was used as the mechanical support and an inherent heat sink for the relays. After cleaning the wafer, an oxide was thermally grown on the wafer. The relays were made following the process sequences described in FIGS. 1A and 1B. One relay was connected to a curve tracer through a probe station to monitor the state of the contact. On the curve tracer, the two states, "on" (a sloped straight line) and "off" (a horizontal line), were observed. The slope of the curve on the tracer was the sum of the relay resistance, connecting wire resistance and the internal load resistance of the curve tracer. By shorting at the probes, the sum of the internal resistance and the connecting wire resistance was measured—1.3 ohm. After subtracting 1.3 ohm from the measured slope, it was estimated that the resistance of the relay at the "on" state is less than 0.1 ohm. In like relays, contact resistance values lower than 20 milliohms had been observed. The overall relay resistance will be even lower when scaling up the blade size or by connecting several relays in parallel.

It is found that the relay can carry up to 10 A of current which implies $10^5$ A/cm$^2$ going through the 10 μm (in thickness) blade. With such a high current density, the relay could only last a few seconds before it showed burn marks and was damaged permanently. Thus, with the 1 mm wide, 10 $\mu$m thick blade, the relay can handle a 10 A surge, but cannot carry a 10 A load continuously. However, it was found that the FIGS. 1A–1B relay could carry a 2 A current load continuously.

Using a pulsed actuation voltage to control the "open" and "close" state of a wire bonded, packaged relay, the operation cycles of the relay were monitored with the curve tracer. Different current loads, micro-ampere to 50 mA, were used for the reliability measurements. It showed that the relays were able to operate for more than $10^6$ cycles without failure at such current loads.

Using a voltage source connecting to a 1 kilo-ohm resistor load and the contact terminal of the relay, the switching of a relay is monitored by measuring the voltage at the contact terminal of the relay. When the relay is electrically "open", the monitored voltage is the same as the voltage source, 6V. When the relay is at electrically "close" position, the monitored voltage drops to the ground potential. Measured results showed that with 0.5s "on" and 0.5s "off" pulsed 20V applied to the actuator, the voltage at the contact terminal responded to the actuation voltage accordingly.

A packaged micro-relay like that depicted in FIGS. 1A and 1B was used to control a 12V motor to deflect a side mirror of a vehicle. The coil of the motor in the mirror driving mechanism has an inductance of 12 mH. When breaking the contact of the relay, the energy stored in the coil of the mirror motor, $LI^2/2$, will be discharged through the contact gap. Here, L is the inductance of the motor coil and I is the current flow through the coil before the actuator is turned off. An induced voltage with a magnitude of L (dI/dt) will be exposed to the contact, too. To estimate the magnitude of the power discharged through the air gap, it was found the current in the motor coil was 0.2 to 0.5 A before the breaking. The time needed for the blade to electrically separate from the contact was measured. It took shorter than 60 $\mu$s to have an open circuit at the relay. In order to dissipate 4 to 25 W of power, destructive arcs will form at the contact gap. These localized arcings between blade and contact can create local melting and short circuits. In additional to the discharge, an induced voltage surge is also generated across the motor coil with a magnitude of 40 to 100V. This high voltage could be presented to the relay contact terminal. The unwanted voltage surge could cause problems for the deposited silicon nitride film. The film has a thickness of 0.15 $\mu$m and is on top of the actuator. It was found that using micro-relays to control the side mirror had low operation cycles.

On a separate experiment, a packaged micro-relay was used to switch on and off a 12V, 5.5 W fan which had a coil with very low inductance. During switchings, it was found that higher than 1 A of surged current flowed through the micro-relay. The surged current in the fan operation was higher than that in the side mirror experiment. The relay was able to switch the fan on and off for more than several hundred cycles without failure. The energy spikes encountered during switching are very important to the micro-relay's durability.

To demonstrate the concept of using a solid state device to handle the energy spikes during switchings, a Zener diode was added in the side mirror deflection experiment. A Zener diode was connected to the contact terminal of the micro-relay to discharge the energy spikes caused by the opening of the relay contact. With a Zener diode clamped to the contact terminal of the relay, the relay was able to control the motor operation or the deflection of the side mirror satisfactorily. The Zener diode used in here was a 5 W diode with a nominal breakdown voltage of 18V. The anode of the Zener diode was connected to the ground and the cathode connected to the relay contact terminal. If there was a reverse voltage surge with respect to the Zener diode, the diode offered a current path to discharge the surge voltage. When opening the contact of the micro-relay, an induced voltage will forward bias the Zener. The energy stored in the motor coil would discharge through the diode with significantly less energy going through the relay. At steady state, most of the current will flow through the relay. This is because the on resistance of the relay is much lower than the resistance of the diode which is reversibly biased in this arrangement. Because the diode is mainly used in handling the "transients" during switchings which are very short in time, a low cost, low power rating diode can effectively do the job. The Zener diode absorbed the energy spikes encountered during the contact openings of the micro-relay. However, during the contact closings of the micro-relay, the Zener diode offered a discharge path only when the voltage surged to higher than 18V. Even with a partial protection to the micro-relay, the operation cycles of the relay in the side mirror application have been extended from failed at tens of cycles to more than hundreds of cycles without failure.

When a micro-relay was put in the circuit as was described in FIG. 10, the protected micro-relay was used to switched a 0.35 A load successfully; for around 5,000 cycles without failure. The number of operation cycles can be increased more by reducing the contact resistance of the relay to low milliohms range.

While this invention has been described in terms of some specific embodiments, it will be appreciated that other forms and scale-up sizes can readily be adapted by one skilled in the art. Accordingly, the scope of this invention is to be considered limited only by the following claims.

We claim:

1. An electrostatically-actuated, metallic micro-relay comprising a semiconductor substrate having an electrically insulative surface layer, a metal blade having two ends, a length, width and thickness, and a plurality of longitudinal slots extending through the thickness of said blade, said blade overlying said insulative layer and anchored at at least one of said ends to said layer, an electrostatic actuator on said insulative layer underlying said blade, said actuator being operable between an actuator off condition and an actuator on condition, there being a first gap dimension between said blade and said actuator when the actuator is in said off condition, and an electrical contact on said layer engageable by said blade when said actuator is in said on condition, said contact being spaced from said blade by a second gap dimension during said off condition.

2. A micro-relay as recited in claim 1 in which said blade is anchored at both of its ends to said insulative layer of said substrate.

3. A micro-relay as recited in claim 1 in which said second gap dimension is less than said first gap dimension.

4. A micro-relay as recited in any of claims 1 through 3 in which said substrate is silicon with a silicon dioxide insulative surface layer.

5. A micro-relay as recited in any of claims 1 through 3 in which said blade is formed of electroformed copper and said contact comprises electroformed copper.

6. A micro-relay as recited in any of claims 1 through 3 in which the width and thickness of said blade are sized to carry a continuous current of two amperes.

7. A micro-relay as recited in claim 6 in which the length of said blade is in a range of 1 to 3 millimeters, the width of said blade is in a range of 0.5 to 1.5 millimeters and the thickness of said blade is in a range of 5 to 20 micrometers.

8. A micro-relay as recited in claim 7 further comprising an arc suppression circuit operatively connected with said micro-relay to receive electrical power during the opening and closing of said relay.

9. A micro-relay as recited in claim 6 further comprising an arc suppression circuit operatively connected with said micro-relay to receive electrical power during the opening and closing of said relay.

10. A micro-relay as recited in any of claims 1 through 3 in which said slots extend for at least half the length of said blade.

11. A micro-relay as recited in 10 in which each said slot has a width in a range of 10 to 40 micrometers.

12. A micro-relay as recited in claim 11 further comprising an arc suppression circuit operatively connected with said micro-relay to receive electrical power during the opening and closing of said relay.

13. A micro-relay as recited in claim 10 further comprising an arc suppression circuit operatively connected with said micro-relay to receive electrical power during the opening and closing of said relay.

14. A micro-relay as recited in any of claims 1 through 3 in which said blade extends over said electrical contact and a portion of the blade overlying said contact contains a plurality of holes through the thickness of said blade.

15. A micro-relay as recited in 14 in which said holes have a cross-sectional dimension in a range of 10 to 40 micrometers.

16. A micro-relay as recited in claim 14 further comprising an arc suppression circuit operatively connected with said micro-relay to receive electrical power during the opening and closing of said relay.

17. A micro-relay as recited in any of claims 1 through 3 further comprising an arc suppression circuit operatively connected with said micro-relay to receive electrical power during the opening and closing of said relay.

18. A micro-relay as recited in claim 17 further comprising control means providing a set actuation voltage to said micro-relay.

19. An electrostatically-actuated, metallic micro-relay comprising a semiconductor substrate having an electrically insulative surface layer, a metal blade having two ends, a length, width and thickness, and a plurality of longitudinal slots extending through the thickness of said blade, said slots not extending to either of said two ends, said blade overlying said insulative layer and anchored at at least one of said ends to said layer, an electrostatic actuator on said insulative layer underlying said blade, said actuator being operable between an actuator off condition and an actuator on condition, there being a first gap dimension between said blade and said actuator when the actuator is in said off condition, and an electrical contact on said layer engageable by said blade when said actuator is in said on condition, said contact being spaced from said blade by a second gap dimension during said off condition.

* * * * *